United States Patent [19]

Stevens

[11] Patent Number: 4,608,926

[45] Date of Patent: Sep. 2, 1986

[54] SWIVEL TYPE THROUGH BULKHEAD INITIATOR

[75] Inventor: George L. Stevens, North Ogden, Utah

[73] Assignee: Thiokol Corporation, Chicago, Ill.

[21] Appl. No.: 650,139

[22] Filed: Sep. 13, 1984

[51] Int. Cl.[4] ..... F42B 19/08; F42C 5/00

[52] U.S. Cl. ..... 102/275.4; 89/1.14

[58] Field of Search ..... 102/275.11, 275.12, 102/275.4, 275.5, 275.6, 275.7, 202, 200, 224; 89/1.14

[56] References Cited

U.S. PATENT DOCUMENTS

| | | | |
|---|---|---|---|
| 3,209,692 | 10/1965 | Webb | 102/275.4 |
| 3,238,876 | 3/1966 | Allen | 102/275.4 |
| 3,630,151 | 12/1971 | Rakowsky | 102/202 |
| 3,762,267 | 10/1973 | Travor et al. | 89/1.14 |
| 3,954,322 | 3/1976 | Carlson et al. | 102/275.4 |
| 3,982,488 | 9/1976 | Rakowsky et al. | 102/244 X |
| 4,423,682 | 1/1984 | Schimmel | 89/1.14 X |

FOREIGN PATENT DOCUMENTS

| | | | |
|---|---|---|---|
| 0030498 | 6/1981 | European Pat. Off. | 102/275.4 |

*Primary Examiner*—David H. Brown
*Attorney, Agent, or Firm*—Gerald K. White

[57] ABSTRACT

The acceptor charge is initiated from the side and the donor charge is contained in a full circle swivel assembly. This allows the initiator to be used where little head clearance is available and use, also, of the initiator to transmit a shock wave through a solid barrier or bulkhead to a relatively movable body.

10 Claims, 1 Drawing Figure

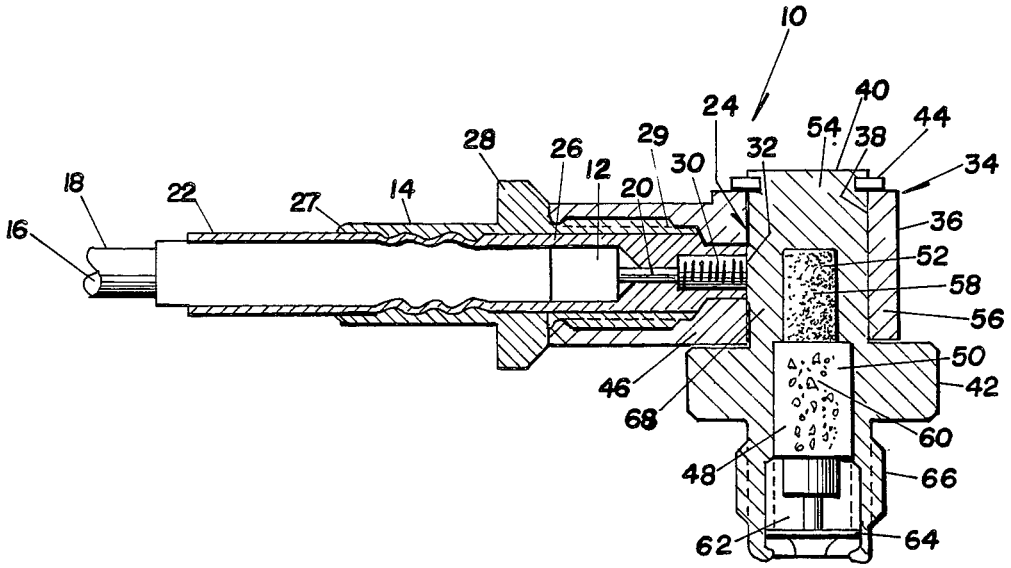
10
24
40
44
54
38
32
34
28
26
29
12
30
20
18
22
27
14
16
36
52
58
56
50
42
46
68
60
48
66
62
64

SWIVEL TYPE THROUGH BULKHEAD INITIATOR

BACKGROUND OF THE INVENTION

1. Field of the Invention

This invention relates to pyrotechnic systems, and more particularly, to such systems in which an ignition reaction or shock wave is transmitted through a solid barrier or bulkhead to initiate explosive functions. Such systems have utility in igniters, gas generators, explosive devices, and actuators.

2. Description of the Prior Art

Through bulkhead initiators are known and used in the prior art in ordnance applications which have an explosive transfer line to initiate a pyrotechnic type of ordnance device. Such initiators accept an explosive signal from the ordnance transfer assembly and converts it to a hot gas output on the downstream side of a solid barrier or bulkhead. This barrier provides a pressure seal during operation of the ordnance item. The barrier or bulkhead must have the structural integrity to withstand both the detonation sequence and the operational pressure of the ordnance device and desirably, therefore, may be made of a material such as stainless steel.

The initiation stimulus is transmitted through the sealed metal bulkhead through shock waves. The shock wave generated by detonation of the donor charge is transferred to the metal bulkhead and is propagated therethrough to an acceptor charge. The metal bulkhead is not structurally degraded by the passage of the shock wave. Sufficient energy is contained in the shock wave to cause a detonation reaction to the acceptor charge. This reaction is transmitted to an output charge where it is transformed into a deflagration reaction.

The through bulkhead initiators of the prior art are characterized in being in-line, rigid systems which require considerable head clearance for installation. Thus, there has been a need for a through bulkhead initiator where little clearance is available. There has also been a need for such an initiator for transmitting a shock wave through a solid barrier or bulkhead to a relatively movable body, such, for example, as the gas generator of an airbag system mounted on an automobile steering wheel.

SUMMARY OF THE INVENTION

An object of the invention is to provide, for initiating various explosive functions, a through bulkhead initiator characterized by low body height and having particular utility in ordnance applications where there is limited space.

A further object of the invention is to provide a through bulkhead initiator wherein the acceptor charge is initiated from the side and the donor charge is contained in a full circle swivel assembly whereby the initiator is operable in applications having little head clearance to transmit a shock wave through a solid barrier or bulkhead to a relatively movable body.

Another object of the invention is to provide such an improved through bulkhead initiator that provides a pressure seal during the operation of the ordnance item.

In accomplishing these and other objectives of the invention, there is provided an improvement in through bulkhead initiators that incorporates a swivel action. This swivel action allows the initiator to be used where little head clearance is available. Novel features of the improved initiator include side initiation of the acceptor charge, the donor charge being contained in a full circle swivel assembly, and a low overall initiator height.

DESCRIPTION OF THE DRAWINGS

Having described the invention, a detailed description follows with reference being made to the accompanying single FIGURE of drawing which forms part of the specification and comprises a cross sectional view of the through bulkhead initiator according to the invention.

DESCRIPTION OF THE PREFERRED EMBODIMENT

In the drawing the through bulkhead initiator 10 of the invention is illustrated in conjunction with an end portion 12 of an ordnance transfer line 14 which forms part of an ordnance transfer assembly (not shown). The ordnance transfer line 14 comprises a confined detonating cord 16 contained within and protected by a braided cover or shield 18. The end portion 12 has a confined detonating fuze 20 at its end and is provided with a protective cover 22 and with suitable attachment means for facilitating the attachment thereof to the input side, indicated generally at 24, of the through bulkhead initiator 10. Such attachment may be effected, as shown in the drawing by a flexible locking nut 26 and an adapter fitting 28 having first and second ends with a screw thread formed on each end. Thus, an internal screw thread on a first end 27 of the adapter fitting 28 is in engagement with an external thread on the flexible locking nut 26 and is operative to cause the locking nut 26 to squeeze and firmly retain therein the protective cover 22 and thereby the end portion 12 of the ordnance transmission line 14. The screw thread on the second end 29 of the adapter fitting is used to attach the end portion 12 of line 14 to the input side 24 of initiator 10 in a manner described hereinafter.

A donor charge 30 of Pentaerythritoltetranitrate (PETN) is provided in the open end 32 of the locking nut 26, adjacent the confined detonating fuze 20. Other donor charge explosives such as hexanitrostilbene (HNS) and Hexogen (cyclonite) (RDX) can be used for the donor charge 30. The open end 32 of the locking nut 26, as shown in the drawing, extends somewhat beyond the end of the adapter fitting 28 when nut 26 and fitting 28 are in assembled operative relation, as shown. The donor charge 30 is sealed with a thin closure at the open end 32 of nut 26. This surface is in close proximity with a barrier 54 described hereinafter to insure efficient transmission of the explosive shock wave to a steel bulkhead barrier 68.

The input side 24 of initiator 10 includes, as part of a full circle swivel assembly indicated at 34, a swivel sleeve 36 having a cylindrical bore or opening 38 therein that is arranged to receive for relative angular or swivelling movement a cylindrical portion or hub member 40 of an initiator body 42. Body 42, desirably, may be made of steel. A retaining ring 44 is provided, as shown, for retaining swivel sleeve 36 on initiator body 42. Disposed at a right angle to the axis of cylindrical opening 38 of sleeve 36 and formed integrally therewith is a sleeve fitting 46 having an internal screw thread that is adapted to receive in threaded engagement therewith an external screw thread on the second end 29 of adapter fitting 28. The arrangement is such that, when assembled, the end of flexible locking nut 26 is flush with the inner cylindrical surface 32 of the opening 38 of swivel sleeve 36.

Formed in the initiator body 42 is a cavity 48. Cavity 48 includes communicating bores 50 and 52 having a common axis with the bore 52 being smaller in diameter and entending part way only through the hub member 40 of the initiator body 42. There is thus formed at the upper end of hub member 40, as seen in the drawing, an end closure and sealing barrier 54 for cavity 48. This barrier 54 together with the cylindrical walls of cavity 48 serve as a pressure seal for the ordnance device to be activated. A cylindrical wall 56 that is associated with bore 52 and swivel sleeve 36 desirably has a substantially uniform cross section.

Contained within the bore 52 is an acceptor charge 58 of PETN. Other acceptor charge explosives such as HNS and RDX can be used for the acceptor charge 58. An ignition or output charge 60 of suitable explosive material is contained within bore 50, the output charge 60 being located adjacent to and in communication with the acceptor charge 58. An orifice plug 62 and closure plate 64 for the initiator body 42 may also be provided, as shown. Additionally, an attachment screw thread 66 may be provided on the lower end of body 42, as seen in the drawing, for attaching the initiator 10 to an ordnance device (not shown) to be activated.

With the foregoing arrangement, the cylindrical wall 68 of uniform cross section comprises the barrier or bulkhead through which a shock wave generated by detonation of donor charge 30 is propagated to the acceptor charge 58. The wall 68 may be made of steel and is not structurally degraded by the passage therethrough of the shock wave. The energy contained in the shock wave causes a detonation reaction in the acceptor charge 58. This reaction is transmitted to the ignition or output charge 60 where it is transformed into a deflagration reaction.

Thus, there has been provided, according to the invention, an improved through bulkhead initiator 10 which has a low overall height and incorporates a swivel action to allow use of the initiator where little head clearance is available. Its novel features include side activation through the solid metal barrier or bulkhead, wall 68, with the donor charge 30 being contained in an assembly allowing the transmission of a shock wave through the solid barrier or bulkhead to a relatively movable body, and in particular, allowing a full circle swivel action while providing a pressure seal.

What is claimed:

1. A through bulkhead initiator comprising:

a donor charge, an acceptor charge, and a full circle swivel assembly including a swivel sleeve and an initiator body, said swivel sleeve containing said donor charge, said initiator body having a cavity formed therein with a sealing barrier at one end, the wall of at least a portion of said cavity adjacent said barrier being cylindrical and having a substantially uniform cross section, said acceptor charge being contained within said portion of said cavity, said swivel sleeve being positioned, with respect to said body, in surrounding relation with said portion of said cavity.

2. An initiator as defined in claim 1 wherein said swivel sleeve has a wall forming an inner bore having a cylindrical surface, and said donor charge is contained in said wall substantially flush with said cylindrical surface of said bore.

3. An initiator as defined in claim 2 further including, a detonating fuze, an ordnance transfer line having an end, said end containing said fuze, and attachment means for attaching said end of said ordnance transfer line to the wall of said swivel sleeve with said fuze in communicating relation with said donor charge.

4. An initiator as defined by claim 3 wherein said attachment means comprises, a sleeve fitting integrally formed with said swivel sleeve, a connector adapter fitting, and a flexible locking nut, said connector adapter fitting having first and second ends with a screw thread formed on each end, said sleeve fitting having a screw thread adapted for engagement with the screw thread at the second end of said adapter connector fitting, said flexible locking nut having a screw thread adapted for engagement with the screw thread at the first end of said adapter connector fitting and being disposed in embracing relation with the end of said ordnance transfer line whereby effecting threaded engagement of said adapter connector fitting with said locking nut attaches and retains the end of said ordnance transfer line in engagement with said locking nut and engagement of said adapter connector fitting with said sleeve fitting connects said ordnance transfer line to said swivel sleeve.

5. An initiator as defined in claim 1 further including an output charge contained in said cavity in communication with said acceptor charge.

6. An initiator as defined in claim 5 wherein said acceptor charge is positioned in said cavity between said charge and said barrier.

7. An initiator as defined in claim 6 including attachment means on said initiator body at a position remote from said barrier for attaching said initiator to and placing said cavity in communicating relation with an ordnance device to be activated.

8. An initiator as defined in claim 7 wherein each of said donor and acceptor charges comprise PETN.

9. An initiator as defined in claim 7 wherein each of said donor and acceptor charges comprise HNS.

10. An initiator as defined in claim 7 wherein each of said donor and acceptor charges comprise RDX.

* * * * *